US008284069B2

(12) United States Patent
Sverrisson

(10) Patent No.: US 8,284,069 B2
(45) Date of Patent: Oct. 9, 2012

(54) SYSTEM AND METHOD FOR DETECTING A BOUNDARY CROSSING EVENT

(75) Inventor: Heimir Sverrisson, Portsmouth, NH (US)

(73) Assignee: Cadec Global, Inc., Manchester, NH (US)

( * ) Notice: Subject to any disclaimer, the term of this patent is extended or adjusted under 35 U.S.C. 154(b) by 548 days.

(21) Appl. No.: 12/503,306

(22) Filed: Jul. 15, 2009

(65) Prior Publication Data

US 2010/0033338 A1 Feb. 11, 2010

Related U.S. Application Data

(60) Provisional application No. 61/080,740, filed on Jul. 15, 2008.

(51) Int. Cl.
*G08B 21/00* (2006.01)

(52) U.S. Cl. ..... 340/686.1; 340/988; 340/995.17; 701/1

(58) Field of Classification Search ..... 340/686.1, 340/988, 995.1, 995.17; 382/103, 104, 106; 701/1, 205, 207, 208
See application file for complete search history.

(56) References Cited

U.S. PATENT DOCUMENTS

| | | | | |
|---|---|---|---|---|
| 5,801,618 | A | 9/1998 | Jenkins | |
| 6,122,584 | A | 9/2000 | Lin et al. | |
| 6,819,980 | B2 | 11/2004 | Bauer et al. | |
| 7,443,298 | B2 * | 10/2008 | Cole et al. | 340/572.4 |
| 2007/0067085 | A1 | 3/2007 | Lu et al. | |
| 2010/0124356 | A1 * | 5/2010 | Hampapur et al. | 382/103 |

* cited by examiner

*Primary Examiner* — Toan N Pham
(74) *Attorney, Agent, or Firm* — Peter A. Nieves; Sheehan Phinney Bass + Green

(57) ABSTRACT

Model zone data and model subzone data is employed to simplify calculations for determining where and/or when a boundary crossing event has occurred. A system for detecting a boundary crossing event employs a memory and a processor. The processor in one embodiment is configured by the memory to perform the steps of sensing current position; comparing the sensed current position to model zone data to determine presence within a geometric figure constructed around a boundary crossing point; comparing the sensed current position to model subzone data to determine presence within a first portion of the geometric figure; comparing the sensed current position to model subzone data to determine presence within a second portion of the geometric figure; and detecting a boundary crossing event as a result of movement from the first portion of the geometric figure to the second portion of the geometric figure.

20 Claims, 5 Drawing Sheets

SYSTEM AND METHOD FOR DETECTING A BOUNDARY CROSSING EVENT

CROSS-REFERENCE TO RELATED APPLICATION

This application claims priority to copending U.S. Provisional Patent Application entitled "System And Method For Detecting A Boundary Crossing Event," having Ser. No. 61/080,740, filed 15 Jul. 2008, which is hereby incorporated herein in its entirety by reference.

FIELD OF INVENTION

The present invention is generally related to a system and method for detecting a boundary crossing event, and more particularly is related to a system and method for detecting a boundary crossing event in real-time such as may be carried out with use of a position sensing system while traveling in a vehicle.

BACKGROUND OF INVENTION

There are many situations where it may be desirable to automatically determine in real-time when and/or where a boundary or border between respectively different geographical regions has been crossed. Ability to automatically detect such a boundary crossing event might be useful in the context of interstate trucking or other modes of transportation across boundaries between geographical regions having respectively different tax regimes. Without such ability, entities carrying out interstate trucking within the continental U.S. may find it difficult to conveniently calculate the proper amount of fuel tax that is due to respective states based on travel within those states. For example, accurate calculation of such fuel tax might typically require tedious logging of odometer readings at times when each state is entered and exited. Furthermore, a credit corresponding to fuel tax paid at the time of any fuel purchase made while within that state might need to be subtracted from the fuel tax due to that state. It has typically been practical to perform such calculations only following return to an office where clerical operations including entry of these odometer readings and fuel purchases into a computer for processing can be carried out.

To automatically determine in real-time when or where a boundary between geographical regions has been crossed would conventionally require ability to access and process large amounts of data. Any conventional system possessing such ability would likely be expensive and cumbersome.

It would therefore be desirable if a convenient method could be found to model the area in the vicinity of such a boundary in a way that would facilitate calculations as necessary for determination of when the boundary has been crossed to a reasonable accuracy. It would furthermore be desirable if the model employed were able to simplify calculations to the point where such calculations could be easily carried out in real-time by an onboard computing device.

Thus, a heretofore unaddressed need exists in the industry to address the aforementioned deficiencies and inadequacies.

SUMMARY

Embodiments of the present invention provide a system and method for detecting a boundary crossing event. For example, in accordance with one embodiment, boundary crossing event detection may be carried out in real-time with use of a position sensing system while traveling in a vehicle.

In accordance with one aspect of the present invention, model zones and model subzones are created that simplify calculations for determining presence within and transition between geographical regions in the vicinity of a geographical border. In accordance with another aspect of the present invention, those model zones and model subzones are employed to determine where and/or when a boundary crossing event has occurred.

A system for detecting a boundary crossing event in accordance with one embodiment contains a memory and a processor. The processor may be configured by the memory to sense current position. The processor may furthermore be configured by the memory to compare the sensed current position to model zone data to determine presence within a geometric figure constructed around a boundary crossing point. The processor may furthermore be configured by the memory to compare the sensed current position to model subzone data to determine presence within a first portion of the geometric figure. The processor may furthermore be configured by the memory to compare the sensed current position to model subzone data to determine presence within a second portion of the geometric figure. The processor may furthermore be configured by the memory to detect a boundary crossing event as a result of movement from the first portion of the geometric figure to the second portion of the geometric figure.

The first and second portions of the geometric figure may share a common border that intersects the boundary crossing point. The common border shared by the first and second portions of the geometric figure may be a line segment that is more or less perpendicular to a line connecting the boundary crossing point with a perpendicular construction point farther in a direction of travel on a path along which a vehicle would travel in crossing the boundary crossing point. A line connecting the border crossing point and the perpendicular construction point may be approximately parallel to the path along which a vehicle would travel in crossing the boundary crossing point. The common border shared by the first and second portions of the geometric figure may be a line segment that is more or less perpendicular to a path along which a vehicle would travel in crossing the boundary crossing point. The geometric figure may be a rectangle, and the first and second portions of the geometric figure may respectively be trapezoidal.

The processor may furthermore be configured by the memory to record the boundary crossing event in association with at least one species selected from among the group consisting of: location of the boundary crossing point, name of the boundary crossing point, location of the first portion of the geometric figure, location of the second portion of the geometric figure, name of a first geographical region corresponding to the first portion of the geometric figure, name of a second geographical region corresponding to the second portion of the geometric figure, name of a boundary that was crossed as a result of the boundary crossing event, direction in which the boundary was crossed, name of a road along which a vehicle would travel in crossing the boundary crossing point, time at which the boundary crossing event was detected, odometer reading at the time that the boundary crossing event was detected, remaining fuel at the time that the boundary crossing event was detected, tolls due as a result of the boundary crossing event, tax due based on distance traveled within the first geographical region, credit due based on one or more purchases made while within the first geographical region.

The geometric figure may be a square at least length L on a side, L being given by $L=2*N*T_0*V_{max}$, where $N=2$, $T_0$ is a time interval between successive position sensing events as determined by a slow sampling rate in effect at a time when the sensed current position is determined not to be within the geometric figure, and $V_{max}$ is a maximum posted speed on a road along which a vehicle would travel in crossing the boundary crossing point.

The processor may furthermore be configured by the memory to vary the sampling rate at which the sensing of current position is carried out in correspondence to whether the sensed current position is determined to be within the geometric figure. The sampling rate at which the sensing of current position is carried out may be varied such that $T_1<T_0$, where $T_1$ is a time interval between successive position sensing events as determined by a fast sampling rate in effect following a time when the sensed current position is determined to be within the geometric figure.

It may be the case that an error with which the boundary crossing event is detected is not more than E, E being given by $E=V_c/T_1+E_{pos}$, where Vc is a speed with which the movement from the first portion of the geometric figure to the second portion of the geometric figure takes place, and $E_{pos}$ is a maximum error with which the sensing of current position is carried out.

Another embodiment is a model zone/subzone data structure stored on a computer-readable medium. The data structure may contain model zone data representing a plurality of model zones, each of the model zones being a geometric figure constructed around a boundary crossing point. The data structure may furthermore contain model subzone data representing a plurality of model subzones respectively associated with the model zones. The model subzones associated with the model zones may be respective portions of the geometric figures at those model zones. A first trapezoidal model subzone among the model subzones may be bounded on three sides thereof by a perimeter of a first model zone of which it is a first portion and may be bounded on a fourth side thereof by a line segment that intersects a first border crossing point around which the first model zone was constructed and that is a common border shared with a second trapezoidal model subzone that is a second portion of the first model zone.

Yet another embodiment is a model zone/subzone data structure stored on a computer-readable medium. The data structure may contain border crossing point data representing a border crossing point where a road crosses a geographical boundary. The data structure may furthermore contain model zone data representing a model zone constructed so as to be centered on the border crossing point. The data structure may furthermore contain model boundary data representing a model boundary constructed within the model zone, the model boundary being approximately perpendicular to the road at the border crossing point. The data structure may furthermore contain model subzone data representing a plurality of model subzones constructed within the model zone, each of the model subzones within the model zone being bounded on one side by the model boundary within the model zone.

Another embodiment is a computer-readable medium having stored thereon computer-executable instructions for configuring a processor to sense current position. The instructions may furthermore be for configuring a processor to compare the sensed current position to model zone data to determine presence within a geometric figure constructed around a boundary crossing point. The instructions may furthermore be for configuring a processor to compare the sensed current position to model subzone data to determine presence within a first portion of the geometric figure. The instructions may furthermore be for configuring a processor to compare the sensed current position to model subzone data to determine presence within a second portion of the geometric figure. The instructions may furthermore be for configuring a processor to detect a boundary crossing event as a result of movement from the first portion of the geometric figure to the second portion of the geometric figure. The instructions may furthermore be for configuring a processor to vary the sampling rate at which the sensing of current position is carried out in correspondence to whether the sensed current position is determined to be within the geometric figure. The geometric figure may be a rectangle, and the first and second portions of the geometric figure may respectively be trapezoidal.

A system for constructing model zone data and model subzone data in accordance with one embodiment contains a memory and a processor. The processor may be configured by the memory to identify a border crossing point where a road crosses a geographical boundary. The processor may furthermore be configured by the memory to construct a model zone centered on the border crossing point. The processor may furthermore be configured by the memory to construct a model boundary within the model zone, the model boundary being approximately perpendicular to the road at the border crossing point. The processor may furthermore be configured by the memory to construct a plurality of model subzones within the model zone. Each of the model subzones within the model zone may be bounded on three side by a perimeter of the model zone. Each of the model subzones within the model zone may be bounded on one side by the model boundary within the model zone. The model zone may be rectangular, and each of the plurality of model subzones within the model zone may be trapezoidal.

A boundary crossing event detection system in accordance with one embodiment contains model construction means for creating model zone data and model subzone data. The boundary crossing event detection system may furthermore contain position sensing means for sensing current position. The boundary crossing event detection system may furthermore comprise position comparison means for determining when the sensed position is within model zones and model subzones. The boundary crossing event detection system may furthermore contain boundary crossing event detection means for detecting movement between model subzones.

Other embodiments, systems, methods, and features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

BRIEF DESCRIPTION OF DRAWINGS

Many aspects of the invention can be better understood with reference to the following drawings. The components in the drawings are not necessarily to scale, emphasis instead being placed upon clearly illustrating the principles of the present invention. Moreover, where more than one view is provided in the drawings, like reference numerals designate corresponding parts throughout the several views.

DETAILED DESCRIPTION

Aspects of the present invention include a system and a method for detecting a boundary crossing event in real-time. For example, boundary crossing event detection may be carried out with use of a position sensing system while traveling in a vehicle. In accordance with one aspect of the present invention, model zones and model subzones are created that simplify calculations for determining presence within and transition between geographical regions in the vicinity of a geographical border. Data containing information defining such model zones and model subzones is referred to herein as model zone data and model subzone data. In accordance with another aspect of the present invention, model zone data and model subzone data may be employed to determine where and/or when a boundary crossing event has occurred.

Note that where the description below refers to a system for detecting a boundary crossing event in accordance with one aspect of the present invention, this description should be understood to apply as well to a method in accordance with other aspects of the present invention with modification as appropriate. The present system may be provided by a Web-based application. The following description assumes that the present system is provided by a Web-based application. It should be noted that the system may also be provided in an environment that is not Web-based.

The boundary crossing event detection system of the invention can be implemented in software (e.g., firmware), hardware, or a combination thereof. In the currently contemplated best mode, the boundary crossing event detection system is implemented in software, as an executable program, and is executed by a special or general purpose digital computer, such as a personal computer (PC; IBM-compatible, Apple-compatible, or otherwise), workstation, minicomputer, or mainframe computer. Specifically, the boundary crossing event detection system, as provided by the computer, may be accessible via a Web site, through which parties using the boundary crossing event detection system may interact. Further description of the boundary crossing event detection system, and interaction therewith is provided below.

Figure 1:
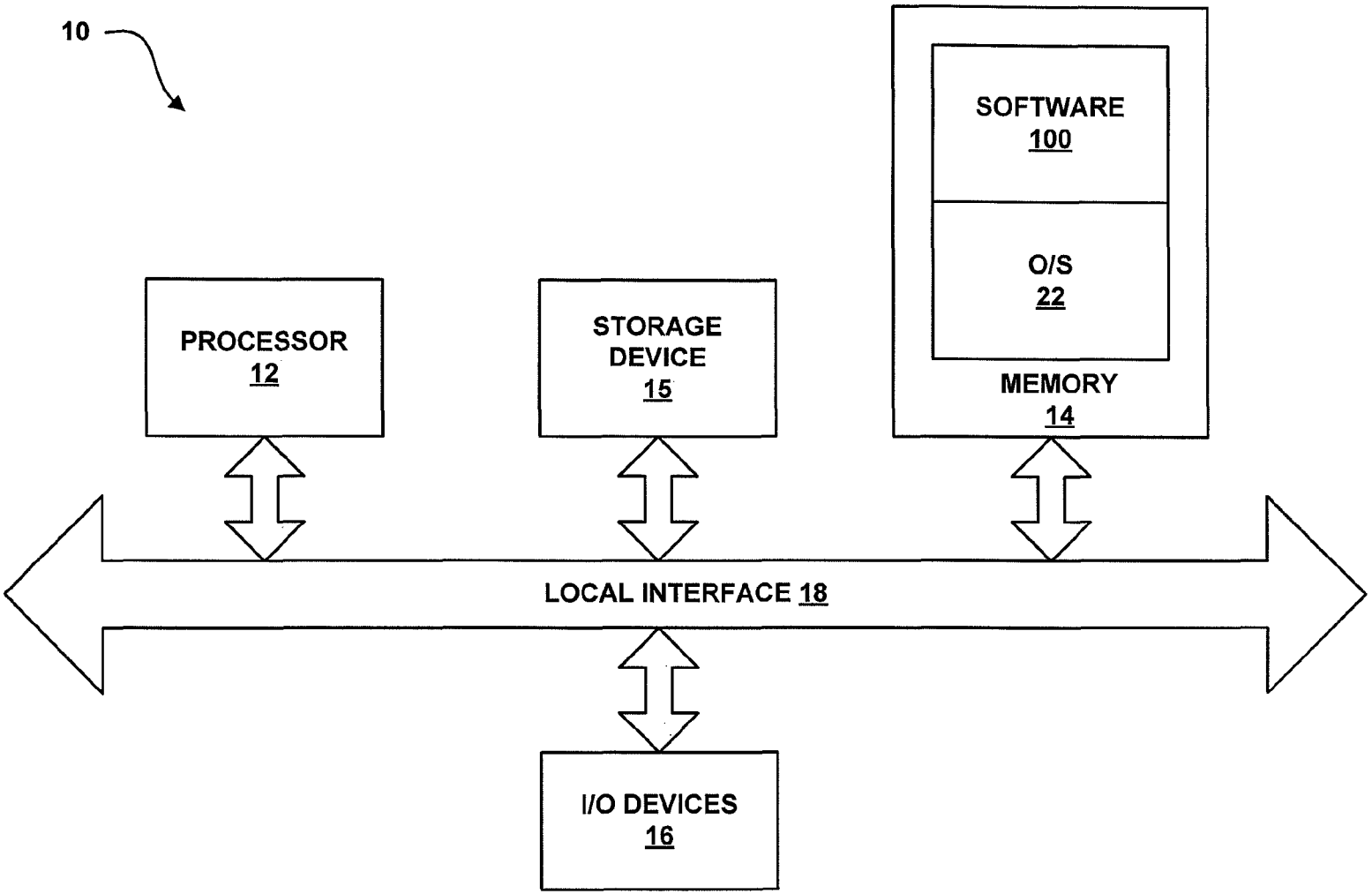
FIG. 1 is a schematic diagram showing an example of a general purpose computer and associated software for implementing a system and method for detecting boundary crossing events in accordance with the present invention.

An example of a general purpose computer that can implement the boundary crossing event detection system of the present invention is shown in FIG. 1. In FIG. 1, the boundary crossing event detection system is denoted by reference numeral 10. It should be noted that communication with the boundary crossing event detection system may be provided by multiple means such as, but not limited to, the Internet. Further description with regard to use of the boundary crossing event detection system via use of the Internet is provided below.

Generally, in terms of hardware architecture, as shown in FIG. 1, the computer 10 includes a processor 12, memory 14, storage device 15, and one or more input and/or output (I/O) devices 16 (or peripherals) that are communicatively coupled via a local interface 18. The local interface 18 can be, for example but not limited to, one or more buses or other wired or wireless connections, as is known in the art. The local interface 18 may have additional elements, which are omitted for simplicity, such as controllers, buffers (caches), drivers, repeaters, and receivers, to enable communications. Further, the local interface may include address, control, and/or data connections to enable appropriate communications among the aforementioned components.

The processor 12 is a hardware device for executing software, particularly that stored in the memory 14. The processor 12 can be any custom made or commercially available processor, a central processing unit (CPU), an auxiliary processor among several processors associated with the computer 10, a semiconductor based microprocessor (in the form of a microchip or chip set), a macroprocessor, or generally any device for executing software instructions.

The memory 14 can include any one or combination of volatile memory elements (e.g., random access memory (RAM, such as DRAM, SRAM, SDRAM, etc.)) and nonvolatile memory elements (e.g., ROM, hard drive, tape, CDROM, etc.). Moreover, the memory 14 may incorporate electronic, magnetic, optical, and/or other types of storage media. Note that the memory 14 can have a distributed architecture, where various components are situated remote from one another, but can be accessed by the processor 12.

The software 100 in memory 14 may include one or more separate programs, each of which contains an ordered listing of executable instructions for implementing logical functions of the boundary crossing event detection system, as described below. In the example of FIG. 1, the software 100 in the memory 14 defines the boundary crossing event detection system functionality in accordance with the present invention. In addition, the memory 14 may contain an operating system (O/S) 22. The operating system 22 essentially controls the execution of computer programs and provides scheduling, input-output control, file and data management, memory management, and communication control and related services.

Instructions for implementing the boundary crossing event detection system 10 may be provided by a source program, executable program (object code), script, or any other entity containing a set of instructions to be performed. When a source program, then the program needs to be translated via a compiler, assembler, interpreter, or the like, which may or may not be included within the memory 14, so as to operate properly in connection with the O/S 22. Furthermore, instructions for implementing the boundary crossing event detection system 10 can be written as (a) an object oriented programming language, which has classes of data and methods, or (b) a procedure programming language, which has routines, subroutines, and/or functions.

The I/O devices 16 may include input devices, for example but not limited to, a keyboard, mouse, scanner, microphone, or other device. Furthermore, the I/O devices 16 may also include output devices, for example but not limited to, a printer, display, etc. Finally, the I/O devices 16 may further include devices that communicate via both inputs and outputs, for instance but not limited to, a modulator/demodulator (modem; for accessing another device, system, or network), a radio frequency (RF) or other transceiver, a telephonic interface, a bridge, a router, etc.

When the boundary crossing event detection system 10 is in operation, the processor 12 is configured to execute the software 100 stored within the memory 14, to communicate data to and from the memory 14, and to generally control operations of the computer 10 pursuant to the software 100. The boundary crossing event detection system 10 and the O/S 22, in whole or in part, but typically the latter, are read by the processor 12, perhaps buffered within the processor 12, and then executed.

When the boundary crossing event detection system 10 is implemented in software, as is shown in FIG. 1, it should be noted that instructions for implementing the boundary crossing event detection system 10 can be stored on any computer-readable medium for use by or in connection with any computer-related system or method. Such a computer-readable medium may, in some embodiments, correspond to either or both the memory 14 or the storage device 15 shown in FIG. 1. In the context of this document, a computer-readable medium is an electronic, magnetic, optical, or other physical device or means that can contain or store a computer program for use by or in connection with a computer-related system or method. Instructions for implementing the boundary crossing event detection system 10 can be embodied in any computer-readable medium for use by or in connection with the processor 12 or other such instruction execution system, apparatus, or device. Although the processor 12 has been mentioned by way of example, such instruction execution system, apparatus, or device may, in some embodiments, be any computer-based system, processor-containing system, or other system that can fetch the instructions from the instruction execution system, apparatus, or device and execute the instructions. In the context of this document, a "computer-readable medium" can be any means that can store, communicate, propagate, or transport the program for use by or in connection with the processor 12 or other such instruction execution system, apparatus, or device.

Such a computer-readable medium can be, for example but not limited to, an electronic, magnetic, optical, electromagnetic, infrared, or semiconductor system, apparatus, device, or propagation medium. More specific examples (a nonexhaustive list) of the computer-readable medium would include the following: an electrical connection (electronic) having one or more wires, a portable computer diskette (magnetic), a random access memory (RAM) (electronic), a read-only memory (ROM) (electronic), an erasable programmable read-only memory (EPROM, EEPROM, or Flash memory) (electronic), an optical fiber (optical), and a portable compact disc read-only memory (CDROM) (optical). Note that the computer-readable medium could even be paper or another suitable medium upon which the program is printed, as the program can be electronically captured, via for instance optical scanning of the paper or other medium, then compiled, interpreted or otherwise processed in a suitable manner if necessary, and then stored in a computer memory.

In an alternative embodiment, where the boundary crossing event detection system 10 is implemented in hardware, the boundary crossing event detection system 10 can be implemented with any or a combination of the following technologies, which are each well known in the art: a discrete logic circuit(s) having logic gates for implementing logic functions upon data signals, an application specific integrated circuit (ASIC) having appropriate combinational logic gates, a programmable gate array(s) (PGA), a field programmable gate array (FPGA), or other technologies.

Figure 2:
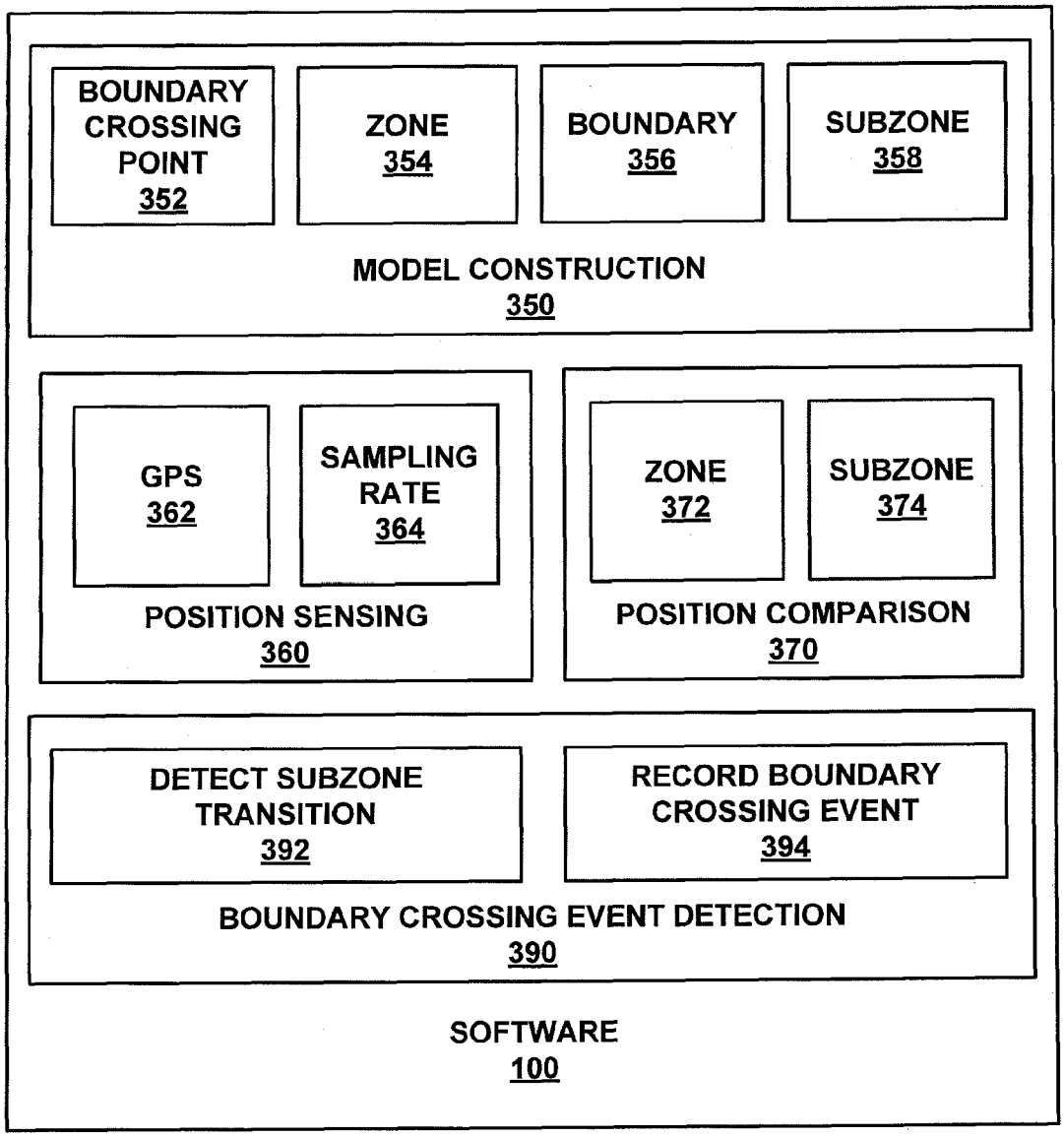
FIG. 2 is a schematic diagram showing functional blocks representing functionality defined by the software at FIG. 1, in accordance with a first exemplary embodiment.

Referring to FIG. 2, this is a schematic diagram showing functional blocks representing functionality defined by the software 100 of FIG. 1, in accordance with a first exemplary embodiment of the invention. In accordance with the present embodiment, the software 100 includes a model construction module 350, a position sensing module 360, a position comparison module 370, and a boundary crossing event detection module 390.

For practical determination of when a boundary crossing event has occurred, it is convenient to construct a simplified geometric model of the area in the vicinity of a point where a boundary between geographical regions can be crossed. The model construction module 350 of the present embodiment is equipped with such functionality. In the present embodiment, the model construction module 350 includes a boundary crossing point identification module 352, a model zone construction module 354, a model boundary construction module 356, and a model subzone construction module 358. Functionality provided by the model construction module 350 and the various modules included therewithin is described in further detail below.

The position sensing module 360 of the present embodiment includes functionality for sensing current position. For example, in the present embodiment shown in FIG. 2, the GPS module 362 of the position sensing module 360 may include equipment capable of utilizing the Global Positioning System (hereinafter "GPS") or other such position sensing equipment to determine current position. In addition to the GPS module 362, the position sensing module 360 in the present embodiment includes a sampling rate module 364 capable of varying position sensing sampling rate in correspondence to position, specifically in correspondence to whether current position is within a model zone 150, as will be described in further detail below.

The position comparison module 370 of the present embodiment includes functionality for comparing current position as sensed by the position sensing module 360 to the simplified geometric model constructed by the model construction module 350. In the present embodiment, the position comparison module 370 includes a zone comparison module 372 and a subzone comparison module 374. The zone comparison module 372 has functionality for comparing current position as sensed by the GPS module 362 to model zone(s) 150 constructed by the model zone construction module 354. Similarly, the subzone comparison module 374 has functionality for comparing current position as sensed by the GPS module 362 to model subzone(s) 115, 125 constructed by the model zone construction module 354.

The boundary crossing event detection module 390 of the present embodiment includes functionality for detecting and recording occurrence of a boundary crossing event. In the present embodiment, the boundary crossing event detection module 390 includes a subzone transition detection module 392 and a boundary crossing event recording module 394. Functionality provided by the boundary crossing event detection module 390 and the modules included therewithin is described in further detail below.

Figure 3:
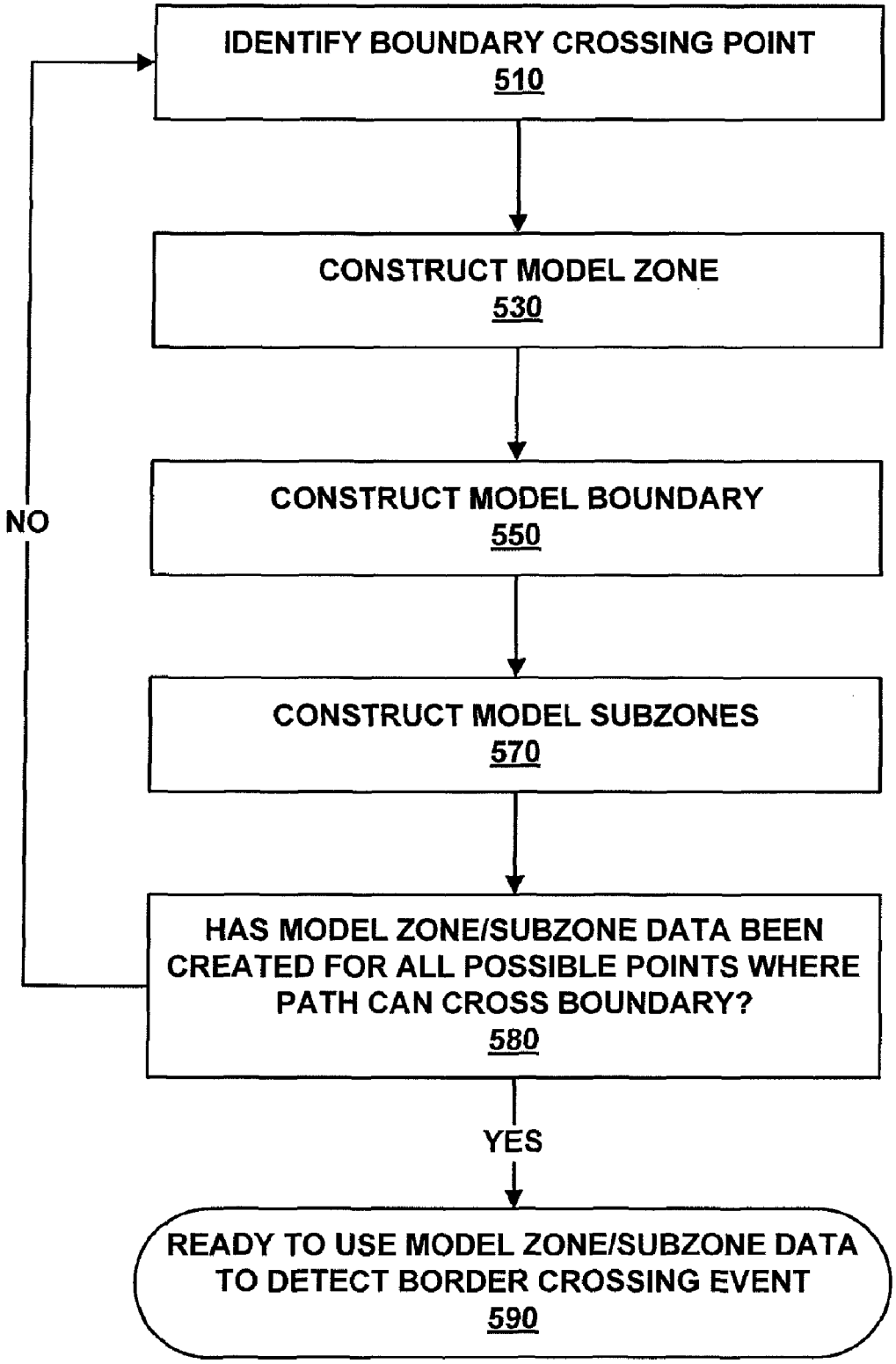
FIG. 3 is a flowchart showing a procedure for creating model zone data and model subzone data, such as the model zone data and model subzone data of FIG. 4.

FIG. 3 is a flowchart showing how the model construction module 350 may create model zone data and model subzone data in accordance with the first embodiment. In accordance with the present embodiment, model zone/subzone data represent geometric constructs that allow calculation to be carried out for determining when a boundary crossing event has occurred.

It should be noted that any process descriptions or blocks in flow charts should be understood as representing modules, segments, portions of code, or steps that include one or more instructions for implementing specific logical functions in the process, and alternate implementations are included within the scope of the present invention in which functions may be executed out of order from that shown or discussed, including substantially concurrently or in reverse order, depending on the functionality involved, as would be understood by those reasonably skilled in the art of the present invention.

In general, considering the number of locations where real-world roads 105 cross real-world borders 130 into or out of a given geographical region (see FIG. 4 for an example), it will be assumed for purposes of the present description that there are a finite number of points at which such boundary crossing events can occur. In accordance with the present embodiment, model zone data and model subzone data is created in advance for all such possible boundary crossing points of interest by following a procedure such as that of the flowchart of FIG. 3.

Figure 4:
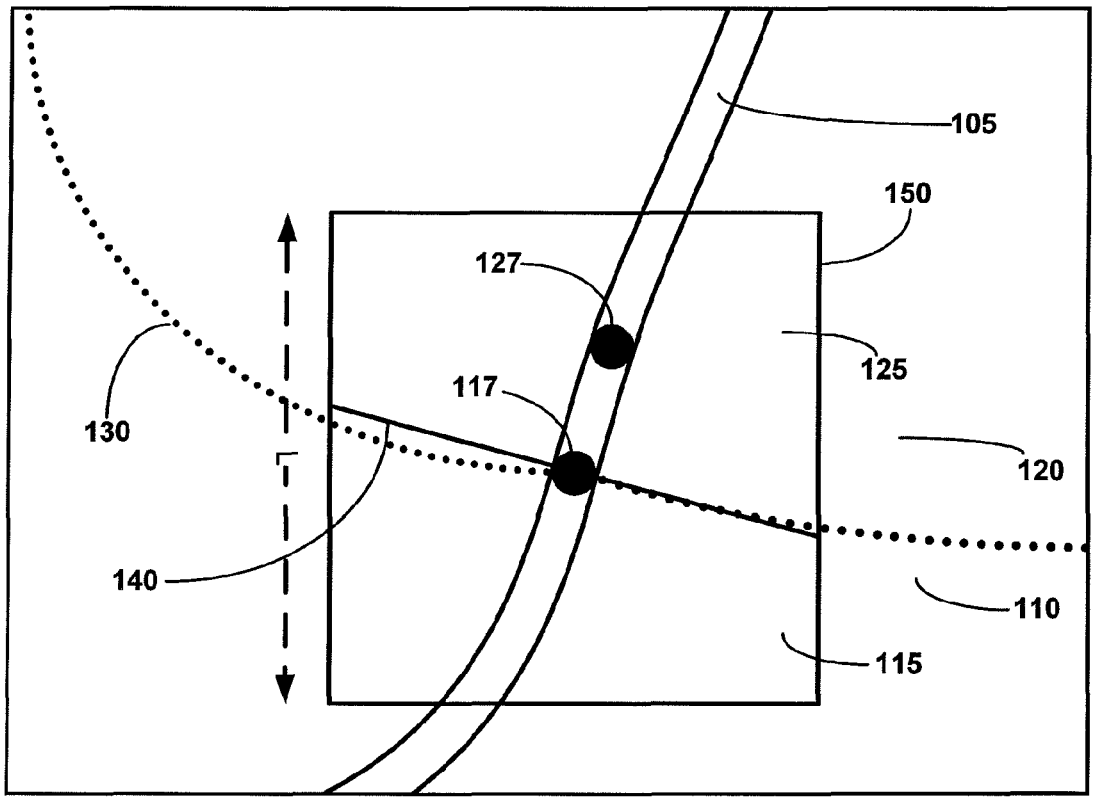
FIG. 4 is a schematic diagram showing model zone data and model subzone data such as may be used to detect a boundary crossing event in accordance with the first embodiment.

As shown by block 510, the boundary crossing point identification module 352 identifies a boundary crossing point 117 (FIG. 4). Here, a boundary crossing point 117 (FIG. 4) is one of any number of points at which a geographical region can be entered or exited by way of a road or other such path 105 (FIG. 4). More specifically, a boundary crossing point 117 (FIG. 4) is defined as a point where a road or other such path 105 crosses over from a first region 110 (FIG. 4) to a second region (FIG. 4) 120.

The meaning of these terms, and other terms related to construction of zones and subzones to model the geographical area in the vicinity of a boundary crossing point 117, will be made clearer by referring to FIG. 4.

FIG. 4 shows the geographical area around a location at which a road or other such path 105 intersects a geographical boundary 130. The boundary crossing point 117 is the point at which the path 105 intersects or crosses the geographical boundary 130. The geographical boundary 130 is a border between a first geographical region 110 and a second geographical region 120. The geographical regions 110, 120 may, for example, be neighboring states in the continental U.S.A.

In interpreting FIG. 4, it might be imagined, for example, that a vehicle having a position sensing system and traveling along the path 105 from the first region 110 into the second region 120 would cross the geographical boundary 130 and would go from the boundary crossing point 117 toward a perpendicular construction point 127, described below.

Returning to the flowchart of FIG. 3, as well as FIG. 4 as shown by block 530, the model zone construction module 354 constructs a model zone 150. An example of such a model zone 150 is superposed centrally on the geographical area shown in FIG. 4.

The model zone 150 is a geometric construct that in accordance with the present embodiment is a rectangular region centered on the boundary crossing point 117 identified by the boundary crossing point identification module 352 at block 510. In the present embodiment, the model zone 150 is constructed by the model zone construction module 354 so as to be centered on the boundary crossing point 117 and so as to be a square region at least length L on a side, L being given by equation shown below, $$L=2*N*T_0*V_{max} \quad \text{(Eq. 1)}$$

where N, which is preferably greater than or equal to 2, is the minimum number of desired position samples to be taken while in each the first region 110 and the second region 120; $T_0$ is the time interval between successive position reports; and $V_{max}$ is the maximum speed of the vehicle. Employment of a model zone 150 in the form of a square at least length L on a side as defined above will permit at least N position readings to be taken within each of a first model subzone 115 and a second model subzone 125 even at maximum vehicle speed (model subzones 115, 125 are as described below).

As shown by block 550, the model boundary construction module 356 constructs a model boundary 140. In the present embodiment, the model boundary 140 is constructed by the model boundary construction module 356 as a line segment bounded by the model zone 150, containing the boundary crossing point 117, and more or less perpendicular to the path 105 in the vicinity of the boundary crossing point 117.

In constructing the model boundary 140, a perpendicular construction point 127 may be employed by the model boundary construction module 356 to facilitate construction of the perpendicular. That is, where such a perpendicular construction point 127 is employed, the perpendicular construction point 127 might be chosen such that a line connecting the boundary crossing point 117 and the perpendicular construction point 127 would be approximately parallel to the path 105 in the vicinity of the boundary crossing point 117. This being the case, where such a perpendicular construction point 127 is employed, the model boundary 140 may be constructed by the model boundary construction module 356 so as to be more or less perpendicular to a line connecting the boundary crossing point 117 and the perpendicular construction point 127.

Regarding the location of the perpendicular construction point 127 relative to the boundary crossing point 117, the perpendicular construction point 127 preferably lies within the second region 120 and is removed by some distance from the boundary crossing point 117. Furthermore, the perpendicular construction point 127 is preferably located on the path 105. In the example shown in FIG. 4, the perpendicular construction point 127 is a point on the path 105 that is farther along in the direction of travel from the boundary crossing point 117. Distance between the boundary crossing point 117 and the perpendicular construction point 127 is relatively unimportant, but the perpendicular construction point 127 employed by the model boundary construction module 356 is preferably such that a line connecting the boundary crossing point 117 and the perpendicular construction point 127 would be approximately parallel to the path 105 in the vicinity of the boundary crossing point 117.

As shown by block 570, the model subzone construction module 358 uses the model boundary 140 constructed at block 550 to divide the model zone 150 into a first model subzone 115 and a second model subzone 125. In the example shown at FIG. 4, the model boundary 140, being a line segment bounded by the model zone 150, divides the square model zone 150 of the present embodiment into trapezoidal model subzones 115, 125, these being a first trapezoidal model subzone 115 and a second trapezoidal model subzone 125. This being the case, the model subzones 115, 125 constructed by the model subzone construction module 358 in the present embodiment share a common border, this being the model boundary 140. Moreover, each trapezoidal model subzone 115, 125 constructed by the model subzone construction module 358 of the present embodiment is bounded on one side by the model boundary 140 and on the other three sides by a portion of the perimeter of the model zone 150.

As shown by block 580, an evaluation is made as to whether model zone/subzone data has been created for all possible or likely points at which it is contemplated that the geographical region can be entered or exited by way of a road or other such path 105. In the event that model zone/subzone data has not yet been created for all possible points at which the geographical region can be entered or exited by way of a road or other such path 105, processing returns to block 510 and model zone/subzone data is created for another possible point at which the geographical region can be entered or exited by way of a road or other such path 105. Processing at blocks 510 through 570 is thus repeated as many times as necessary to create model zone/subzone data for each possible point at which the geographical region can be entered or exited by way of a road or other such path 105 until model zone/subzone data has been created for all possible or likely points at which it is contemplated that the geographical region can be entered or exited by way of a road or other such path 105.

Figure 5:
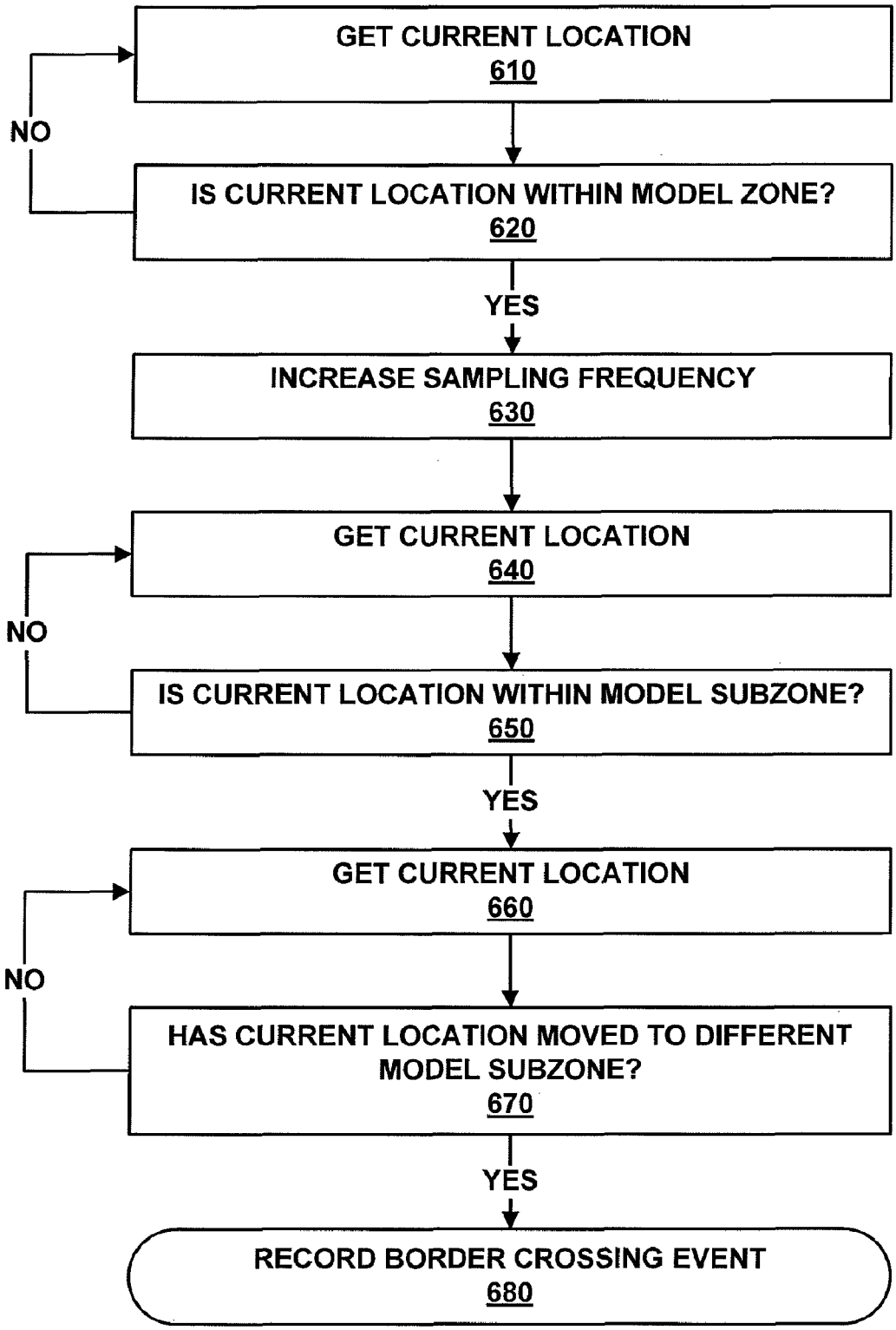
FIG. 5 is a flowchart showing a procedure for using model zone data and model subzone data, such as the model zone and model subzone data created in accordance with the flowchart of FIG. 3, to determine when a boundary crossing event has occurred.

As shown by block 580, in the event that model zone/subzone data has been created for all possible or likely points at which it is contemplated that the geographical region can be entered or exited by way of a road or other such path 105, processing proceeds to block 590, at which the model zone/subzone data created by the model construction module 350 at blocks 510 through 570 is ready to be used to detect a boundary crossing event in accordance with the flowchart of FIG. 5.

The flowchart of FIG. 3 depicts looped flow in which model zone data and model subzone data (here, coordinates representing rectangular model zones and associated model boundaries and/or trapezoidal model subzones), are calculated for each possible location at which a path crosses a boundary. If a path crosses a boundary at more than one location, the procedure in the flowchart of FIG. 3 can be carried out for each location at which the path crosses the boundary. If more than one path crosses a boundary, the procedure in the flowchart of FIG. 3 can be carried out for each path that crosses the boundary. If there is more than one boundary, the procedure in the flowchart of FIG. 3 can be carried out for each boundary. The procedure in the flowchart of FIG. 3 can thus be carried out for each possible location at which a path crosses a boundary. Of course, if it is known that only certain locations or only certain paths or only certain boundaries are of interest, for example because boundary crossing events are unlikely to occur at other than these locations or paths or boundaries, it will be possible to conserve resources by limiting application of the procedure in the flowchart of FIG. 3 to only those locations that are of interest.

Regarding the practicality of creating model zone/subzone data for all possible points at which the geographical region can be entered or exited by way of a road or other such path 105, an example will be considered in which the present embodiment is applied to detection of boundary crossing events within the continental United States. That is, if it is assumed that each state in the continental United States has an average of on the order of 2.2 neighboring states, there might be, on average, approximately 20 crossings of interest between any two states. This would mean that the total number of sets of model zone/subzone data that would need to be created in accordance with the procedure in the flowchart of FIG. 3 for reasonable coverage of possible boundary crossing points would be on the order of several thousand data sets. Unlike the large amount of data that would conventionally be required to carry out boundary crossing event determination, it would not be impractical for the several thousand sets of model zone/subzone data sufficient for boundary crossing event determination in accordance with such an example to be created, even manually if necessary or desirable, and for this amount of data to be made available over a network or stored in an onboard computer or even in a handheld device such as mobile phone. In accordance with such an embodiment, it will be possible to carry out boundary crossing event determination to a precision of on the order of several tens of feet with current position sensing technology, actual precision attainable depending on such factors as the accuracy of the position sensing equipment used as well as whether and to what extent position sensing frequency is increased upon entering the model zone 150 as will be described in further detail below.

Referring to FIG. 5, this is a flowchart showing how model zone data and model subzone data created by the model construction module 350 in accordance with the flowchart of FIG. 3 may be used to determine when a boundary crossing event occurs. In the description given below, it will for convenience continue to be assumed as at the description given above with reference to FIG. 4 that a vehicle crosses a geographical boundary 130 in traveling along a road 105 from a first region 110 into a second region 120. It is further assumed in the description given below that the vehicle has an onboard GPS device or other position sensing equipment capable of implementing the functionality of the position sensing module 360. It is moreover assumed in the description given below that the vehicle has access to a computing device capable of implementing the functionality of the position comparison module 370 and the boundary crossing event detection module 390, and that these modules have access to model zone/subzone data created in accordance with the flowchart of FIG. 3.

The vehicle may have access to the functionality of the position comparison module 370 and the boundary crossing event detection module 390 by way of a network connection to a computer at another location, or the vehicle may be equipped with an onboard computing device that possesses such functionality. The computer may have access to the model zone/subzone data by way of a network connection to a site at which such data is stored, or such data may be stored locally within an onboard computing device, personal digital assistant (hereinafter "PDA"), mobile phone, or other such equipment in the vehicle having sufficient data storage capacity.

As shown by block 610, the GPS module 362 senses the current position of the vehicle. At this time, the sampling rate module 364 in its default state, before entry into a model zone 150 has been detected below at block 620, causes the GPS module 362 to operate at low sampling rate, (low position sensing frequency) such that the time interval between successive position sensing events is $T_0$. Here, to conserve energy, bandwidth, and/or computing resources, this low sampling rate time interval $T_0$ may be set to a sufficiently long time provided only that the time interval employed is, however, short enough to allow detection of entry into the model zone 150, as well as transition from the first model subzone 115 to the second model subzone 125, so as to permit the boundary crossing event to be detected and recorded as described below.

As shown by block 620, the current position as sensed by the GPS module 362 at block 610 is compared with model zone data created by the model zone construction module 354 to determine whether the vehicle is currently within a model zone 150.

In the event that it is determined at block 620 that the vehicle is not within a model zone 150, processing returns to block 610. In the event that it is determined at block 620 that the vehicle is within a model zone 150, processing proceeds to block 630.

As shown by block 630, the sampling rate module 364 causes the GPS module 362 to operate at high sampling rate, (high position sensing frequency) such that the time interval between successive position sensing events is $T_1$. That is, in the event that it has been determined that the vehicle is inside a model zone 150, the sampling rate module 364 causes the time interval between successive position samples as carried out by the position sensing module 360 to be shortened from once every time interval $T_0$ to once every time interval $T_1$ so as to increase position sensing accuracy while within the model zone 150.

As a result of this change in the sampling rate of the GPS module 362 by the sampling rate module 364 at block 630, it is possible to cause the boundary crossing event to be made detectable by the boundary crossing event detection module 390 to within time interval $T_1$ and such that the total position error of detection is not more than that illustrated by equation 2, $$E=V_c/T_1+E_{pos} \quad \text{(Eq. 2)}$$

where E is the total position error (distance from actual geographical boundary 130), Vc is the speed of the vehicle crossing the geographical boundary 130, $T_1$ is the position sampling time interval while inside the model zone 150, and $E_{pos}$ is the maximum error of the position sensing system used to determine the current position by the GPS module 362.

As shown by block 640, the GPS module 362 senses the current position of the vehicle. At this time, as a result of detection of entry into a model zone 150 at block 620 above, the sampling rate module 364 at block 630 has caused the GPS module 362 to operate at 9 high sampling rate, (high position sensing frequency) such that the time interval between successive position sensing events is $T_1$ as explained above.

As shown by block 650, the current position as sensed by the GPS module 362 at block 640 is compared with model subzone data created by the model subzone construction module 358 to determine whether the vehicle is currently within a model subzone 115, 125. Here, because a model zone 150 has already been detected at block 620, only the model subzones 115, 125 within the detected model zone 150 need be employed for comparison.

In the event that it is determined at block 650 that the vehicle is not within one of the model subzones 115, 125, processing returns to block 640. Although not shown in the flowchart of FIG. 5, if after a suitable time following return of processing to block 640, entry into one of the model subzones 115, 125 is still not detected, as a precaution against various errors or unforeseen circumstances, processing might be made to return to block 610 to confirm that the vehicle is still within the previously detected model zone 150 before proceeding further.

In the event that it is determined at block 650 that the vehicle is within one of the model subzones 115, 125, the subzone transition detection module 392 makes note of which of the model subzones 115, 125 the vehicle is determined to be within before processing is allowed to proceed to block 660.

Here, following the example of FIG. 4, where a vehicle is assumed to cross a geographical boundary 130 in traveling along a road 105 from a first region 110 into a second region 120, it will be assumed for convenience of description that this first model subzone detected at block 650 following detection of entry into the model zone 150 at block 620 is the model subzone indicated with reference numeral 115 in the drawing.

As shown by block 660, the GPS module 362 senses the current position of the vehicle. At this time, as it is assumed that the vehicle is still within the model zone 150 detected at block 620 above, the sampling rate module 364 at block 630 continues to cause the GPS module 362 to operate at 9 high sampling rate, (high position sensing frequency) such that the time interval between successive position sensing events is $T_1$ as explained above.

As shown by block 670, the current position as sensed by the GPS module 362 at block 660 is compared with model subzone data created by the model subzone construction module 358 to determine whether the vehicle has entered the second model subzone 125.

In the event that it is determined at block 670 that the vehicle has not entered the second model subzone 125, processing returns to block 660. Although not shown in the flowchart of FIG. 5, if after a suitable time following return of processing to block 660, entry into the second model subzone 125 is still not detected, as a precaution against various errors or unforeseen circumstances, processing might be made to return to block 640 to confirm that the vehicle is still within the previously detected first model subzone 115, and failing that, might be made to return to block 610 to confirm that the vehicle is still within the previously detected model zone 150, before proceeding further.

In the event that it is determined at block 670 that the vehicle has entered the second model subzone 125, because this is taken to indicate that the vehicle has crossed the model boundary 140 constructed by the model boundary construction module 356, which in turn is taken to approximate crossing of the geographical boundary 130 by the vehicle, the subzone transition detection module 392 therefore detects this as a boundary crossing event.

As shown by block 680, following detection of a boundary crossing event at block 670 by the subzone transition detection module 392, the boundary crossing event recording module 394 records the boundary crossing event.

At this time, the boundary crossing event recording module 394 preferably records information sufficient to identify the border that was crossed. For example, the boundary crossing event recording module 394 might record one or more of the following: location of the boundary crossing point 117; name of the boundary crossing point 117; location of the first model subzone 115; location of the second model subzone 125; name of the first geographical region 110; name of the second geographical region 120; name of the geographical boundary 130; direction in which the geographical boundary 130 was crossed; name of the road 105; and time at which the boundary crossing event was detected.

In a preferred embodiment, the boundary crossing event recording module 394 might at this time associate other information with the boundary crossing event that is recorded at block 680. Such other information that may be associated with the boundary crossing event recorded by the boundary crossing event recording module 394 might include times, odometer readings, or other events such as fuel purchases circumstantial to travel by the vehicle within the first geographical region 110 or the second geographical region 120, or across the geographical boundary 130 in going from the first geographical region 110 to the geographical second region 120. In a preferred embodiment, the boundary crossing event recording module 394 might automatically calculate tolls, taxes, surcharges, or other adjustments or calculations related to travel of the vehicle therethrough.

Note that the flowcharts of FIGS. 3 and 5, and the descriptions given with reference thereto, are intended merely to schematically illustrate the invention and are not necessarily intended to rigorously describe specific computer code for implementation of the invention. For example, although not shown in the flowcharts of FIGS. 3 and 5, various error-checking and so-called idiot-proofing techniques might typically be implemented by one skilled in the art. For example, although only brief mention of several examples has been made above, provision would preferably be made for the situation where, at FIG. 5, a vehicle or the like which had entered one model subzone never reaches a different model subzone, because, for example, the vehicle reversed direction, took an undocumented route around the boundary, or otherwise departed the model zone without crossing the boundary.

Although arrows between blocks in the flowchart of FIG. 3 suggest creation of model zone data as occurring in series with creation of model subzone data, this is merely for convenience of description, it being possible in some embodiments for model zone data and model subzone data to be created in an order other than that shown in FIG. 3, and it being possible in some embodiments for model zone data creation and/or access to be separable from model subzone data creation and/or access. For example, all model zone data of interest and all model subzone data of interest might be created and stored in advance locally in an onboard computer or handheld device, for example, or might be made available via network in real-time as needed to carry out boundary crossing event determination in accordance with the flowchart of FIG. 5. Furthermore, because as shown in the flowchart of FIG. 5 model subzone data is not needed until after the current location is within a model zone, it is also possible to separate access to model subzone data (the blocks enclosed within dashed line at FIG. 3) from access to model zone data. For example, in an embodiment in which all model zone data and all model subzone data is created and stored in advance but is not stored directly at an onboard computer or handheld device but is instead stored on a network server to which the onboard computer or handheld device has access, it is possible for access to both model zone data and model subzone data by way of the network to occur in advance or for access to model zone data to precede access to model subzone data, with access to model subzone data for a particular model zone occurring only after the model zone has been entered. One skilled in the art will appreciate that the present invention can be applied to embodiments in which model zone data and/or model subzone data is created in advance or is created in real-time, to embodiments in which such data is stored locally or is stored on a network server, and to embodiments in which such data is retrieved in advance or is retrieved in real-time.

Although the present invention has been described in terms of an example employing a square model zone, more generally the present invention can be applied to any rectangular model zone. Furthermore, although the present invention has been described in terms of an example employing trapezoidal model subzones, more generally the present invention can be applied to model subzones of any suitable shape or shapes. Moreover, although the present invention has been described in terms of an example employing a model zone that is subdivided into nonoverlapping model subzones, there is no particular objection to employment of model subzones that mutually overlap within a model zone.

In the example shown in FIG. 4, the perpendicular construction point 127 is located on the path 105, it being convenient to employ a perpendicular construction point 127 that is on the path 105 when choosing a perpendicular construction point 127 that is relatively close to the border crossing point 117 in a situation where the path 105 is relatively straight. This example has been presented merely for convenience of description, there being no particular objection to employment of a perpendicular construction point 127 that is not on the path 105. One skilled in the art will appreciate that in some embodiments it may be the case that choice of a perpendicular construction point 127 that is not on the path 105 will facilitate satisfaction of the preferred condition that a line connecting the boundary crossing point 117 and the perpendicular construction point 127 be more or less in the same direction as the path 105 in the vicinity of the boundary crossing point 117.

Although the present invention has been described in terms of an example employing a GPS module to sense position through utilization of the Global Positioning System, the present invention is not limited to applications in which position is sensed through utilization of the Global Positioning System, it being possible to employ any suitable position sensing system to determine current location. Mention of GPS and use of a GPS module in the foregoing description should therefore be taken as merely representative of one of any number of possible systems that may be employed for sensing of position in the context of the present invention.

Description given above employs different position sensing sampling rates, the sampling rate module 364 changing sampling rate of the GPS module 362 in correspondence to whether it has been detected that a model zone 150 has been entered. However, where energy, bandwidth, and computing resources allow, there is no particular objection to employing a single sampling rate for the GPS module 362, in which case this sampling rate is preferably chosen so as to give a satisfactory value for total position error E as defined above.

Although the present invention has been described in terms of an example in which a vehicle travels along a road, the present invention may be applied to movement along any suitable path that crosses a border or boundary. For example, the present invention may be applied to the situation where a bicyclist having a GPS-capable mobile phone travels along a bicycle path.

In accordance with one aspect of this invention, data structures containing data representing model zone(s) and/or model subzone(s) may be created and stored in advance or may be created in real-time as such data structures are needed to carry out boundary crossing event determination.

In accordance with another aspect of this invention, in the context of a vehicle having access to a GPS or other such position sensing system, an onboard computer having access to such stored model zone data structures and/or model subzone data structures uses such model zone data structures and/or such model subzone data structures to determine when model zones have been entered and/or exited, when model subzones have been entered/exited, and/or when boundary crossing events have occurred.

In accordance with another aspect of this invention, data structures and/or instructions for carrying out boundary crossing event determination may be stored on a computer-readable and/or machine-accessible medium, or may be embodied in a propagated signal and/or carrier wave. For example, one embodiment of this invention may be a computer-readable medium having stored thereon a data structure modeling a geographical region in the vicinity of an intersection of a path with a boundary, the data structure containing data representing a square model zone, and data associated with the square model zone and representing a model boundary and/or trapezoidal subzones.

As described above, various aspects of this invention permit boundary crossing events to be detected efficiently in terms of achievable levels of accuracy and speed relative to required processing power and/or data storage capacity. For example, by permitting boundary crossing event determination to be carried out with good accuracy using computing devices having modest processing power and/or storage capacity, this invention makes it possible to carry out boundary crossing event determination in real-time using a personal digital assistant, mobile phone, or other onboard computing device having access to GPS or other such position sensing system data.

As described above, boundary crossing event detection systems and methods in accordance with various aspects and embodiments of the present invention solve one or more of the problems mentioned above, and may also provide other advantages and benefits.

It should be emphasized that the above-described embodiments of the present invention are merely possible examples of implementations, merely set forth for a clear understanding of the principles of the invention. Many variations and modifications may be made to the above-described embodiments of the invention without departing substantially from the spirit and principles of the invention. All such modifications and variations are intended to be included herein within the scope of this disclosure and the present invention and protected by the following claims.

What is claimed is:

1. A system for detecting a boundary crossing event, the system comprising:

a memory; and a processor configured by the memory to perform the steps of:

sensing current position;

comparing the sensed current position to model zone data to determine presence within a geometric figure constructed around a boundary crossing point;

comparing the sensed current position to model subzone data to determine presence within a first portion of the geometric figure;

comparing the sensed current position to model subzone data to determine presence within a second portion of the geometric figure; and detecting a boundary crossing event as a result of movement from the first portion of the geometric figure to the second portion of the geometric figure.

2. The system for detecting a boundary crossing event according to claim 1 wherein the first and second portions of the geometric figure share a common border that intersects the boundary crossing point.

3. The system for detecting a boundary crossing event according to claim 2 wherein the common border shared by the first and second portions of the geometric figure is a line segment that is more or less perpendicular to a line connecting the boundary crossing point with a perpendicular construction point farther in a direction of travel on a path along which a vehicle would travel in crossing the boundary crossing point.

4. The system for detecting a boundary crossing event according to claim 3 wherein a line connecting the border crossing point and the perpendicular construction point would be approximately parallel to the path along which a vehicle would travel in crossing the boundary crossing point.

5. The system for detecting a boundary crossing event according to claim 2 wherein the common border shared by the first and second portions of the geometric figure is a line segment that is more or less perpendicular to a path along which a vehicle would travel in crossing the boundary crossing point.

6. The system for detecting a boundary crossing event according to claim 5 wherein the geometric figure is a rectangle, and the first and second portions of the geometric figure are respectively trapezoidal.

7. The system for detecting a boundary crossing event according to claim 1 wherein the processor is furthermore configured by the memory to perform the step of:

recording the boundary crossing event in association with at least one species selected from among the group consisting of location of the boundary crossing point, name of the boundary crossing point, location of the first portion of the geometric figure, location of the second portion of the geometric figure, name of a first geographical region corresponding to the first portion of the geometric figure, name of a second geographical region corresponding to the second portion of the geometric figure, name of a boundary that was crossed as a result of the boundary crossing event, direction in which the boundary was crossed, name of a road along which a vehicle would travel in crossing the boundary crossing point, time at which the boundary crossing event was detected, odometer reading at the time that the boundary crossing event was detected, remaining fuel at the time that the boundary crossing event was detected, tolls due as a result of the boundary crossing event, tax due based on distance traveled within the first geographical region, and credit due based on one or more purchases made while within the first geographical region.

8. The system for detecting a boundary crossing event according to claim 1 wherein the geometric figure is a square at least length L on a side, L being given by $L=2*N*T_0*V_{max}$, where N=2, $T_0$ is a time interval between successive position sensing events as determined by a slow sampling rate in effect at a time when the sensed current position is determined not to be within the geometric figure, and $V_{max}$ is a maximum posted speed on a road along which a vehicle would travel in crossing the boundary crossing point.

9. The system for detecting a boundary crossing event according to claim 8 wherein the processor is furthermore configured by the memory to perform the step of:

varying the sampling rate at which the sensing of current position is carried out in correspondence to whether the sensed current position is determined to be within the geometric figure.

10. The system for detecting a boundary crossing event according to claim 9 wherein the sampling rate at which the sensing of current position is carried out is varied such that $T_1<T_0$, where $T_1$ is a time interval between successive position sensing events as determined by a fast sampling rate in effect following a time when the sensed current position is determined to be within the geometric figure.

11. The system for detecting a boundary crossing event according to claim 10 wherein an error with which the boundary crossing event is detected is not more than E, E being given by $E=V_c/T_1+E_{pos}$, where Vc is a speed with which the movement from the first portion of the geometric figure to the second portion of the geometric figure takes place, and $E_{pos}$ is a maximum error with which the sensing of current position is carried out.

12. A first non-transitory computer-readable medium having stored thereon computer-executable instructions for configuring a processor to perform the step of:

accessing a model zone/subzone data structure stored on a second non-transitory computer-readable medium, wherein the data structure comprises model zone data representing a plurality of model zones, each of the model zones being a geometric figure constructed around a boundary crossing point; and model subzone data representing a plurality of model subzones respectively associated with the model zones;

wherein the model subzones associated with the model zones are respective portions of the geometric figures at those model zones; and wherein a first trapezoidal model subzone among the model subzones is bounded on three sides thereof by a perimeter of a first model zone of which it is a first portion and is bounded on a fourth side thereof by a line segment that intersects a first border crossing point around which the first model zone was constructed and that is a common border shared with a second trapezoidal model subzone that is a second portion of the first model zone.

13. A first non-transitory computer-readable medium having stored thereon computer-executable instructions for configuring a processor to perform the step of:

accessing a model zone/subzone data structure stored on a second non-transitory computer-readable medium, wherein the data structure comprises border crossing point data representing a border crossing point where a road crosses a geographical boundary;

model zone data representing a model zone constructed so as to be centered on the border crossing point;

model boundary data representing a model boundary constructed within the model zone, the model boundary being approximately perpendicular to the road at the border crossing point; and model subzone data representing a plurality of model subzones constructed within the model zone, each of the model subzones within the model zone being bounded on one side by the model boundary within the model zone.

14. A non-transitory computer-readable medium having stored thereon computer-executable instructions for configuring a processor to perform the steps of:

sensing current position;

comparing the sensed current position to model zone data to determine presence within a geometric figure constructed around a boundary crossing point;

comparing the sensed current position to model subzone data to determine presence within a first portion of the geometric figure;

comparing the sensed current position to model subzone data to determine presence within a second portion of the geometric figure; and detecting a boundary crossing event as a result of movement from the first portion of the geometric figure to the second portion of the geometric figure.

15. The non-transitory computer-readable medium according to claim 14 wherein the geometric figure is a rectangle, and the first and second portions of the geometric figure are respectively trapezoidal.

16. The non-transitory computer-readable medium according to claim 14 further having stored thereon computer-executable instructions for configuring a processor to perform the step of:

varying the sampling rate at which the sensing of current position is carried out in correspondence to whether the sensed current position is determined to be within the geometric figure.

17. A system for constructing model zone data and model subzone data, the system comprising:

a memory; and a processor configured by the memory to perform the steps of:

identifying a border crossing point where a road crosses a geographical boundary;

constructing a model zone centered on the border crossing point;

constructing a model boundary within the model zone, the model boundary being approximately perpendicular to the road at the border crossing point; and constructing a plurality of model subzones within the model zone, each of the model subzones within the model zone being bounded on three side by a perimeter of the model zone.

18. The system for constructing model zone data and model subzone data according to claim 17 wherein the model zone is rectangular, and each of the plurality of model subzones within the model zone is trapezoidal.

19. The system for constructing model zone data and model subzone data according to claim 18 wherein each of the model subzones within the model zone is bounded on one side by the model boundary within the model zone.

20. A boundary crossing event detection system comprising:

model construction means for creating model zone data and model subzone data;

position sensing means for sensing current position;

position comparison means for determining when the sensed position is within model zones and model subzones; and boundary crossing event detection means for detecting movement between model subzones.

* * * * *